United States Patent [19]

Taouil

[11] Patent Number: 4,769,526

[45] Date of Patent: Sep. 6, 1988

[54] ROOF DE-ICING PANEL

[76] Inventor: Tony F. Taouil, Box 842, Monroe, N.Y. 10950

[21] Appl. No.: 118,608

[22] Filed: Nov. 9, 1987

[51] Int. Cl.[4] ..... E04D 13/00

[52] U.S. Cl. ..... 219/213; 52/11; 52/12

[58] Field of Search ..... 52/11, 12; 219/213, 219/540, 548

[56] References Cited

U.S. PATENT DOCUMENTS

| | | | |
|---|---|---|---|
| 1,664,171 | 3/1928 | Hicks | 219/213 |
| 3,053,393 | 9/1962 | McLean | 52/12 |
| 3,691,343 | 9/1972 | Norman | 219/213 |
| 4,081,657 | 3/1978 | Stanford | 219/213 |
| 4,308,696 | 1/1982 | Schroeder | 52/11 |
| 4,346,277 | 8/1982 | Wojtecki | 219/540 |
| 4,401,880 | 8/1983 | Eizenhoefer | 52/11 |
| 4,404,775 | 9/1983 | Demartini | 52/11 |

FOREIGN PATENT DOCUMENTS

| | | | |
|---|---|---|---|
| 2061079 | 5/1981 | United Kingdom | 219/548 |

*Primary Examiner*—Henry E. Raduazo
*Attorney, Agent, or Firm*—Arthur L. Frederick

[57] ABSTRACT

The roof de-icing panel comprises a relatively thin metal sheet having a plurality of spaced, substantially parallel channels formed in the bottom planar surface in which electrical heating cables are disposed. The de-icing panel has an integral gutter guard portion which overlies a gutter secured to the drip edge portion of the roof. The channels form juxtaposed raised portions extending above the top planar surface of the sheet to form dams or barriers to the upward flow of water along the top planar surface.

6 Claims, 1 Drawing Sheet

FIG. 3
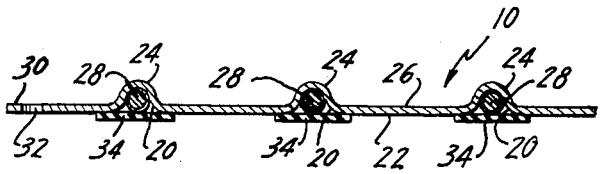
FIG. 5
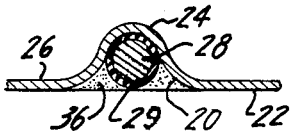
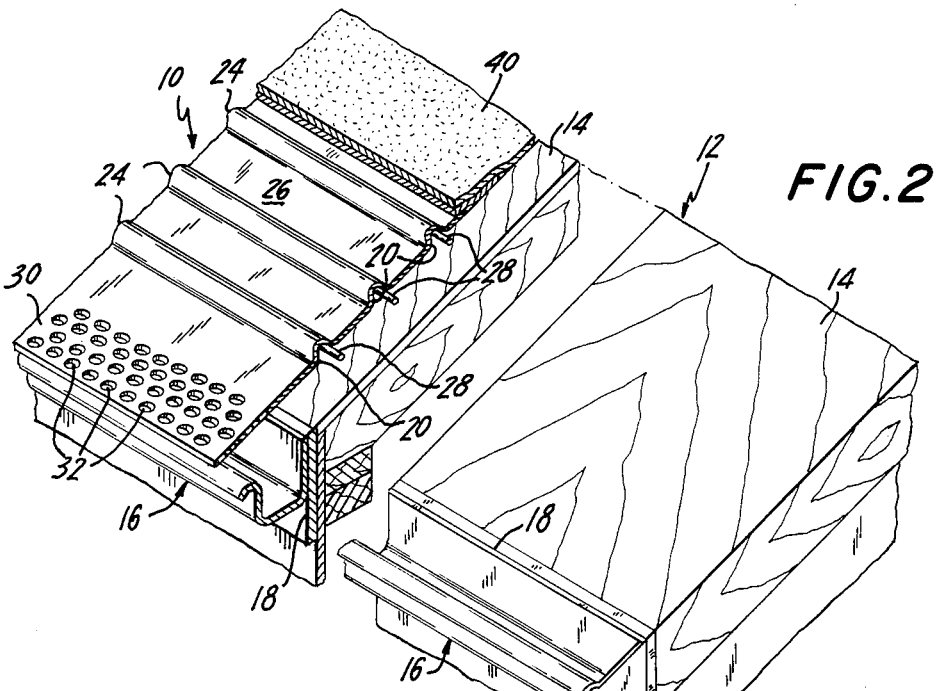
FIG. 2
FIG. 4
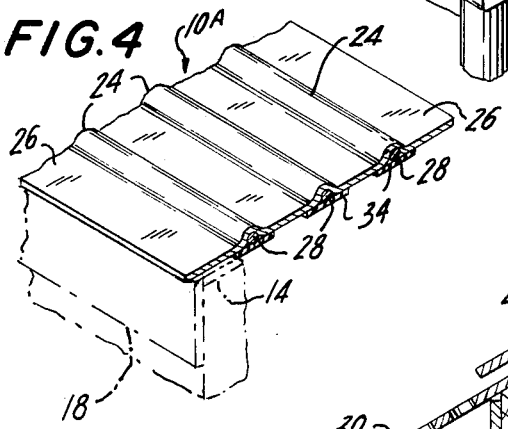
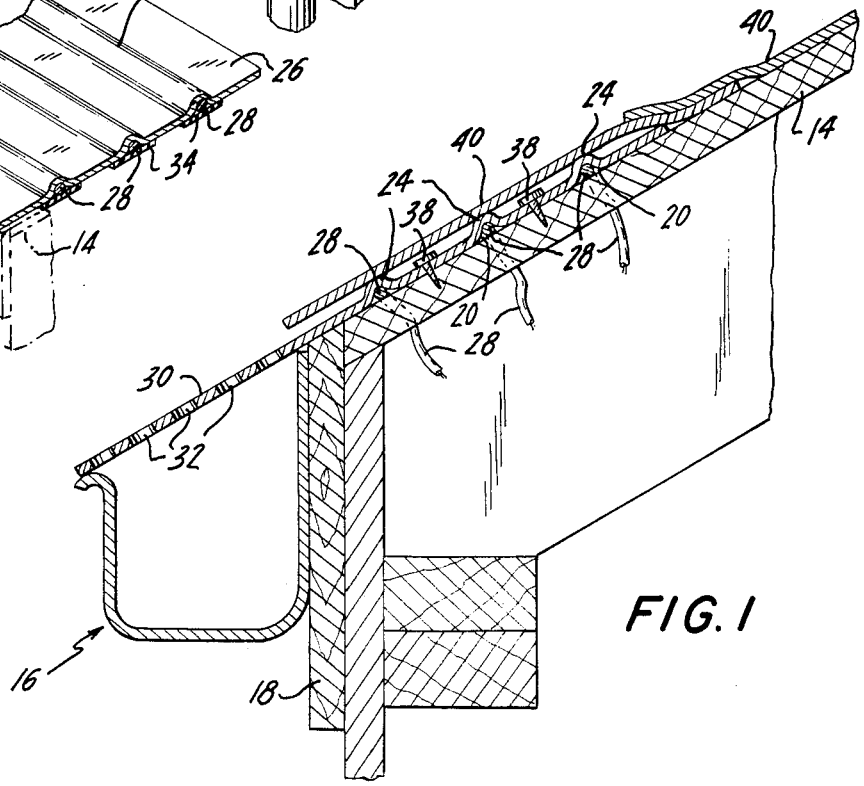
FIG. 1

ROOF DE-ICING PANEL

This invention relates to roofs and more particularly to a de-icing panel for the drip edge of a roof.

BACKGROUND OF THE INVENTION

It is well known that damage to a roof and the resulting leakage thereof frequently occurs by reason of the build-up of ice in a gutter and along the drip edge portion of the roof which causes water flowing down the roof to back-up under the overlapping roof shingles and eventually to the roof sheathing. One suggested solution to this problem is exemplified in the Stanford U.S Pat. No. 4,081,657 in which a roof drip edge strip is made of two plastic sheets bonded together and between which are disposed electric heating coils. This Stanford suggested solution is not entirely satisfactory because it is thermally relatively inefficient. Additionally, if a gutter is provided along the drip edge, leaves and other material can build-up in the gutter causing water flow blockage and the formation of ice which would cause the water melted by the drip edge strip to back-up under the shingles. Also, it is not an apparatus which can be produced on site because extruding and bonding the plastic strips must be done by factory installed equipment. These disadvantages of the Stanford de-icing panel are overcome by the present invention.

Accordingly, it is an object of this invention to provide a more thermally efficient de-icing panel than heretofore known types and which is relatively inexpensive to make and simple to install.

Another object of the present invention is to provide a de-icing panel which also serves as a gutter guard to prevent solid matter such as leaves and twigs from entering the gutter.

A further object of this invention is to provide a de-icing panel that is so formed as to provide a plurality of dams or weirs to block water flow upwardly along its surface.

SUMMARY OF THE INVENTION

Now, therefore, the present invention contemplates a novel roof de-icing panel for disposition adjacent a roof drip edge which comprises a flat sheet of heat conductive material, as for example, aluminum. The sheet is relatively thin, between about 0.32 gage and about 0.27 gage and is of substantially planar, rectangular configuration having top and bottom planar surfaces and upper, lower and opposite side edges. The sheet preferrably has a length substantially the same length as the length of the associated roof drip edge. A channel or a plurality of spaced, substantially parallel channels are formed in the bottom planar surface which form juxtaposed raised portions extending above the adjacent top planar surface. The channels extend in spaced relation to the upper, and lower edges and between the opposite side edges. An electric heating element is disposed in and dimensioned to extend substantially the length of each channel. The heating elements are suitably connected to a source of electrical power to be heated thereby. The source of electric power may be the building electric wiring of 110 v or 220 v AC and be manually or thermostatically controlled as is well known in the art.

The heating elements are preferrably held in their associated channels by a tape of heat insulating, dielectric material applied to overlie each of the channels or by a foam material of insulating and dielectric characteristics applied into the channels to substantially fill the channels.

The juxtaposed raised portions opposite the channels function as dams or weirs to prevent the flow of water upwardly along the de-icing panel and between the over-lying shingles if any, when water flow is blocked by ice and/or snow under conditions where the heating elements are not functioning or until the ice and/or snow is completely melted by the de-icing panel of this invention. By blocking such upward flow, penetration of the water to the roof sheathing is prevented.

BRIEF DESCRIPTION OF THE DRAWINGS

The invention will be more fully understood from the following detailed description thereof when considered in connection with the accompanying drawings wherein the embodiment of this invention is shown by way of illustration and in which, FIG. 1 is a cross sectional view taken vertically through the eaves portion of a shingled roof having a roof de-icing panel according to one embodiment of this invention;

FIG. 2 is a fragmentary view, in perspective, of the eaves portion of a roof having the roof de-icing panel shown in FIG. 1;

FIG. 3 is a fragmentary transverse cross-sectional view of the roof de-icing panel shown in FIGS. 1 and 2 prior to installation;

FIG. 4 is a fragmentary view of a roof de-icing panel according to another embodiment of this invention; and FIG. 5 is a fragmentary cross-sectional view showing alternative means of insulating and securing the electric heating elements in their associated channels.

DESCRIPTION OF THE PREFERRED EMBODIMENTS

Now referring to the drawings and more particularly to FIGS. 1 and 2, the reference number 10 generally designates the roof de-icing panel according to one embodiment of the present invention. The de-icing panel 10 is secured to a roof 12 along the eaves by any suitable means such as nailing to the wood underroofing or roof sheathing 14. The roof 12 may, as shown, be provided with a conventional gutter 16 attached to the facing board 18 of the roof drip edge.

Roof De-icing Panel

The de-icing panel 10 comprises a body of flat sheet metal of relatively high heat conductivity, as for example, aluminum. It is relatively thin in thickness, preferrably between about 0.32 gage and about 0.27 gage, and is preferrably substantially the length of the roof eaves to which it is attached. The de-icing panel 10 is dimensioned in width and so positioned along the eaves that one longitudinal portion thereof overlies the opening of gutter 16. At least one, but preferrably a plurality of spaced, substantially parallel corrugations or channels 20 are formed in the de-icing panel. The channels 20 are formed in the bottom planar surface 22 and form juxtaposed raised portions 24 extending above the adjacent top planar surface 26. Into each channel 20 is disposed a electric heating cable 28. Each of the electric heating cables 28 are connected in any suitable manner to a source (not shown) of electricity for the building and to be heated thereby. To electrically insulate each cable 28 from the metal de-icing panel 10, a plurality of longitudinally spaced dielectric sleeves 29 (FIG. 5) are placed on the cable 28. The sleeves are sized and spaced from each other so that a substantial amount of the surface of cable 28 is exposed to readily transmit heat therefrom to the body of the roofing de-icing panel 10. Alternatively, a single, perforated dielectric sleeve or covering (not shown) may be used instead of a plurality of sleeves 29. The cable 28 in each channel may be one cable doubled upon itself a plurality of times or be separate cables connected in series or in parallel as is well known in the electrical wiring art. One such electrical wiring circuit is disclosed in Stanford U.S. Pat. No. 4,081,657. The panel 10 has an integral gutter screen or guard portion 30 which is in the portion of the de-icing panel 10 which overlies the gutter 16. The gutter portion 30 is formed by a plurality of closely spaced openings 32 which may be elongated or circular in configuration or have any other shape. The gutter guard portion 30 functions to allow water to enter the gutter and prevents solid matter, such as leaves and twigs, which are likely to clog gutter 16, from entering the gutter. Since the gutter guard is an integral part of the de-icing panel 10 it is not likely to be lifted by strong winds and will not collapse into the gutter under the weight of snow and ice.

Installation

The de-icing panel 10 is preferably extruded but may be formed in any suitable way either at the building site or at the factory. The holes 32 which form the gutter guard 30 may also be punched therein at the building site or at a factory. Prior to installation the formed de-icing panel 10 is placed with the top planar surface 26 facing downwardly and the bottom planar surface 22 facing upwardly. The cable 28 is then disposed in each of the channels 20, and, as shown in FIG. 3, held in their respective channels by an adhesive tape 34 of dielectric, heat insulating properties applied over the channels and secured to the bottom planar surface 22. Alternatively, as shown in FIG. 5 a foam plastic 36 of dielectric and heat insulating properties can be applied into each of the channels to fill the space between the cable and the associated channel to substantially the level of the bottom planar surface 22. Since each cable 28 is held in the associated channel, the panel 10 then can be easily positioned on the eaves with the bottom planar surface 22 in abutment against roof sheathing 14. Thereafter, de-icing panel 10 is secured to the roof sheathing in any suitable manner, as for example by a plurality of nails 38 (see FIG. 1). The tapes 34 or foam plastic 36 function not only to hold each of the cables 28 in their associated channel 20 to facilitate handling of the de-icing panels 10 during installation, but serves to protect the roof sheathing 14 from the heat of cable 28 and thereby prevent any possible inadvertant ignition of the roof sheathing 14 which might occur in the event of malfunction or improper operation in a manually controlled system. After the de-icing panel 10 is secured to the roof eaves, the cables 28 are then suitably connected to the electrical service of the building (not shown). As shown in FIG. 1, one or more courses of shingles 40 may be secured to roof sheathing 14 to cover de-icing panel 10, except for the gutter guard portion 30.

Operation

The de-icing panel 10 when connected via a thermostatically or manually operated switch (not shown) receives current through cables 28 which are thereby heated. The heat of the cables is transfered to the body of the de-icing panel 10 which, in turn, is thereby heated. Any accumulation of snow and ice on the gutter guard portion 30 and on the shingles 40 is melted by the transfer of heat to the shingles and gutter guard portion. The raised portions 24, juxtaposed to channels 20, constitute dams or barriers to the flow of water upwardly under the shingles and along the top planar portion 26. This upward flow of water under the shingles might occur if the de-icing panel is not operative or during the period when the de-icing panel is functioning to melt the snow and ice but before it is completely melted, particularly in the area on gutter guard portion 30 which will be slower to melt.

Another Embodiment

In FIG. 4 is shown a de-icing panel 10A according to another embodiment of this invention. It is essentially the same as the de-icing panel 10 shown in FIGS. 1 and 3 and only differs from de-icing panel 10 by not having a gutter guard portion, the roof eaves being shown in FIG. 4 in broken lines. Accordingly, parts of de-icing panel 10A corresponding to the part of de-icing panel 10 will be designated by the same reference number. This de-icing panel 10A is suitable for installation where the roof drip edge is not provided with a gutter.

It is believed now readily apparent that this invention provides a de-icing panel which is thermally efficient and has barriers to the upward water flow along its top surface and prevents water penetrating to the roof sheathing. It is a de-icing panel which has an integral gutter guard. It is a de-icing panel easily and inexpensive to fabricate in the factory or at the building site. It is also simple to install because the electric heating cable can be positioned and held in place prior to installation of the de-icing panel.

Although two embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A roof de-icing panel for disposition adjacent a roof drip edge of a roof having a gutter attached thereto comprising (a) a sheet of material of substantially planar, rectangular configuration, relatively thin in thickness and having top and bottom planar surfaces and upper, lower and opposite side edges, said sheet being of a length substantially equal to the associated drip edge length said sheet having a perforated portion adjacent the lower edge, the sheet being so dimensioned in width and positioned relative to the roof drip edge that the perforated portion overlies the gutter to thereby permit water to enter the gutter but not solid material of a size capable of clogging the gutter;

(b) at least one channel in the bottom planar surface extending between the opposite side edges and in spaced relation to said perforated portion, the channel forming a juxtaposed raised portion extending above the adjacent top planar surface; and (c) an electric heating element disposed in said channel and connected to a source of electric power to be heated by the latter to thereby heat the entire sheet.

2. The apparatus of claim 1 wherein insulating means is provided for heat insulating said electrical heating element from said roof.

3. The apparatus of claim 2 wherein a plurality of spaced substantially parallel channels are provided and wherein an electrical heating element is disposed in each channel with each element being connected to a source of electrical power to be heated therefrom.

4. The apparatus of claim 3 wherein said perforated portion consists of a plurality of spaced rows of spaced holes.

5. A roof de-icing panel for disposition adjacent a roof drip edge of a roof comprising:

(a) a sheet of heat condictive metal of substantially planar, rectangular configuration, relatively thin in thickness and having top and bottom planar surfaces and upper, lower and opposite side edges, said sheet being of a length substantially equal to the associated roof drip edge length;

(b) a plurality of spaced, substantially parallel channels disposed in the bottom planar surface, each of the channels extending between the upper and lower edges and the opposite side edges and forming a juxtaposed raised portion extending above the adjacent top planar surface;

(c) an electrical heating element disposed in each of said channels and connected to a source of electrical power to be heated by the latter and thereby heat the entire sheet; and (d) insulating tape for each channel, each of said insulating tapes being sized to cover an associated channel and secured to the sheet.

6. A roof de-icing panel for disposition adjacent a drip edge of a roof comprising:

(a) a sheet of heat conductive metal of substantially planar, rectangular configuration, relatively thin in thickness and having top and bottom planar surfaces and upper, lower and opposite side edges, said sheet being of a length substantially equal to the associated roof drip edge length;

(b) a plurality of spaced, substantially parallel channels disposed in the bottom planar surface, each of the channels extending between the upper and lower edges and the opposite side edges and forming a juxtaposed raised portion extending above the adjacent top planar surface;

(c) an electrical heating element disposed in each of said channels and connected to a source of electrical power to be heated by the latter and thereby heat the entire sheet; and (d) plastic foam heat insulating material disposed in each channel to substantially fill the channel.

* * * * *